United States Patent [19]

Strecker

[11] Patent Number: 4,648,742

[45] Date of Patent: Mar. 10, 1987

[54] TAINTER GATE SYSTEM

[76] Inventor: Dennis C. Strecker, 1079 Colonial Club Dr., Harahan, La. 70123

[21] Appl. No.: 769,819

[22] Filed: Aug. 27, 1985

Related U.S. Application Data

[63] Continuation of Ser. No. 375,071, May 5, 1982, abandoned.

[51] Int. Cl.[4] ..... E02B 7/46

[52] U.S. Cl. ..... 405/100; 405/87; 251/112

[58] Field of Search ..... 405/86, 87, 99–102, 405/106, 104, 105; 251/90, 112, 300, 301, 297

[56] References Cited

U.S. PATENT DOCUMENTS

| | | | |
|---|---|---|---|
| 657,774 | 9/1900 | Icke | 405/101 X |
| 1,059,037 | 4/1913 | Collar | 251/112 |
| 1,706,219 | 3/1929 | Ely | 405/106 |
| 1,798,952 | 3/1931 | Pellegrino | 251/112 |
| 2,080,063 | 5/1937 | Ring | 61/22 |
| 2,125,090 | 7/1938 | Smyser | 61/22 |
| 2,125,311 | 8/1938 | Peterson | 61/21 |
| 2,186,131 | 1/1940 | Young | 405/100 |
| 2,292,262 | 8/1942 | Alter | 405/100 |
| 2,324,699 | 7/1943 | Harza | 405/100 |
| 2,909,899 | 10/1959 | Ramsden | 405/100 |
| 3,443,788 | 5/1969 | Grove | 251/112 |
| 4,300,858 | 11/1981 | Zintz et al. | 405/100 |

*Primary Examiner*—Cornelius J. Husar
*Assistant Examiner*—Nancy J. Stodola
*Attorney, Agent, or Firm*—Darrell E. Hollis

[57] ABSTRACT

Illustrative embodiments of the invention are directed to a technique for raising and lowering large tainter gates. Typically, two groups of lifting apertures are formed in the gate. A lifting mechanism, resiliently mounted on the tainter gate pier, inserts a movable pin into an aperture in one of the two groups and draws the gate upwardly. A stationary pin on the lifting mechanism then is inserted into an aperture in the other of the two groups to absorb the gate load while the movable pin is withdrawn and moved to a new aperture in order to continue the step-wise lifting process.

To lower a gate, an essentially reverse procedure is followed.

40 Claims, 8 Drawing Figures

TAINTER GATE SYSTEM

The invention described herein may be manufactured, used and licensed by or for the Government for governmental purposes without payment to me of any royalty thereon.

This is a continuation of application Ser. No. 375,071, filed May 5, 1982., now abandoned.

BACKGROUND OF THE INVENTION

1. Field of Invention

This invention relates to method and apparatus for lifting tainter gates and, more specifically to an hydraulically powered pin lift mechanism for raising very large tainter gates in waterways, and the like.

2. Description of the Prior Art

Controlling flow through artifical and natural watercourses is a problem that is as old as civilization itself. Usually, this flow control has been imposed through different types of gates. These gates serve as temporary dams or valves that, when closed, impound water in one portion of the watercourse system or, when open, release accumulated water to permit it to flow into other parts of the system.

Tainter (or taintor) gates, which also are often referred to as "radial" gates, are frequently used for this purpose. Basically, a tainter gate has an upstream face that is curved in the form of an arc, the center of which is at the center of the gate hinge. Raising and lowering the curved face of the gate relative to the hinge opens and closes the watercourse to enable water to flow past the gate or to accumulate upstream of the gate, respectively, depending on the particular needs of the watercourse system.

As watercourse dimensions have increased from the small, primitive irrigation ditches that are still found in many parts of the world to the massive channels of more than seventy feet in depth and sixty feet in width encountered in modern civil engineering practice, the apparatus required to control this flow necessarily must change from simple, manually operated gate valves to large, powerful devices capable of manipulating tainter gates weighing tons against hydraulic forces that are, perhaps, equally great or greater.

A number of techniques have gradually developed through the years for coping with the greater forces that characterize these large watercourses. Illustratively, it has been the practice to couple wireropes to the tainter gates. These wireropes are controlled by means of electrical motor-driven, ribbon-wound cable type hoists to open or close the tainter gates, as desired. Reliance on cable control, however, can lead to a number of difficulties. Typical of these problems is the potential for an uneven load distribution among the wireropes that are secured to both sides of the tainter gates. On occasion, moreover, some of the wireropes wound on which drums have been crushed. This crushing occurs because of the high loads that are applied to the wireropes and the large number of wraps or turns of the cable that are wound onto the drums in order to raise a tainter gate more than 100 feet. These wireropes also create large and undesirable torsional moments in the vertical support beam end frame of the tainter gate, as well as creating undesirable circumferential stresses in the tainter gate skin plate. The large number of wireropes required to control more massive tainter gates introduce still further difficulties in properly tensioning the wireropes and synchronizing their action.

Clearly, as tainter gate sizes increase, it appears that a law of diminishing returns may be overtaking the further application of wirerope technology to watercourse control. More cables, greater lift distances, heavier tainter gates and deeper watercourses all seem to combine to produce the further problems considered above. Accordingly, there is a need for an entirely new approach to tainter gate control.

U.S. Pat. No. 2,125,311 granted Aug. 2, 1938 to B. L. Peterson for "Water Supply and Drainage System for Fishlocks" describes a system in which a tainter valve is directly linked to a rack-and-pinion mechanism. Although this approach overcomes many of the difficulties that have beset wirerope apparatus, the force required for direct gate drive may be excessive for more massive tainter gates, or the mechanical advantage is of such a nature that too much time is required to open these larger gates.

U.S. Pat. No. 2,125,090 granted July 26, 1938 to H. E. Smyser for "Rotatable Water Gate" also discloses a direct mechanical connection between the tainter gate and a worm gear that controls the movement of the gate. Although a worm gear is capable of developing suitable forces, once more the mechanical advantage of this particular mechanism is not acceptable for very large tainter gate installations.

U.S. Pat. No. 2,080,063 granted May 11, 1937 to J. J. Ring for "Roller Gate Construction" also fails to suggest a system that is capable of lifting large tainter gates. Thus, as shown in this patent, a rack, secured to a tainter gate pier meshes with a large pinion gear that is formed on the circumference of the gate structure to enable a chain attached to the gate to draw, or roll the gate up along the rack. The chain in this circumstance must sustain the full load of the gate as it is being lifted, thereby imposing unsatisfactorily inordinate power requirements for large gate application.

Consequently, a need continues to exist for a more efficient and reliable means for lifting or otherwise moving large tainter gates.

SUMMARY OF INVENTION

This need is overcome, to a great extent, through the practice of the invention. Illustratively, a number of equidistantly spaced lifting brackets are attached to the upstream side of the curved face of a tainter gate. Each of these brackets has a generally centrally and horizontally disposed bore and, on the underside of the bracket, an horizontally disposed semicircular recess.

A lifting mechanism is mounted in the pier for the tainter gate in alignment with the brackets. A typical lifting mechanism has a pair of spaced, parallel guide rails that each support respective, oppositely disposed ratchets in which the teeth are oriented to sustain respective pawls in a vertically elevated position. The guide rails are joined at the top by means of a pair of transverse braces that also support an hydraulic cylinder in a manner that permits the piston rod to protrude down into the space between the opposing ratchets. The piston rod, in turn, is connected to a cart that travels between the guide rails through a distance that is about equal to the length of the two ratchets.

The cart not only houses the pawls that engage respective arrays of ratchet teeth but also houses an horizontally disposed movable pin. This movable pin has a diameter that is slightly smaller than the individual diameter of the bracket bores and is hydraulically driven to translate, in an horizontal direction, through a distance that is at least equal to the width of each of the lifting brackets on the curved face of the tainter gate with which it is aligned.

The guide rails are joined at the bottom by means of a pivot pad assembly that also supports a stationary pin. The stationary pin is equal to, or smaller in diameter than the indivdual diameters of the semicircular recesses formed in the underside of the lifting brackets. The stationary pin, too, is hydraulically driven to translate horizontally through a distance that is at least equal to the width of each of the lifting brackets.

To raise the tainter gate, the movable pin is inserted into a lifting bracket bore and the hydraulic cylinder is activated to draw the cart vertically through a distance that is slightly greater than the separation between two adjacent lifting brackets. The stationary pin then is extended under the semicircular recess of the bracket immediately below the bracket in which the movable pin is engaged. The pawls in the cart are retracted and the hydraulic cylinder lowers the tainter gate through a short distance to enable the stationary pin to be received within the bracket recess.

In this way, the tainter gate load is transferred from the movable pin to the stationary pin to enable the hydraulic system to extract the movable pin from the bracket bore and return the cart to the bottom of the guide rails. With the cart abutting the pivot pad, the movable pin is aligned with the bore in the bracket that is resting upon the stationary pin. The hydraulic system inserts the movable pin into this new bracket bore and the stationary pin is retracted to transfer the load once more to the movable bracket. This process is repeated in order to raise the gate in a step-by-step manner to a desired height.

To lower the gate, the procedure is reversed, the movable pin lowering each successive bracket on to the extended stationary pin, the stationary pin in this instance being retracted to enable the bracket with which it just had been engaged to pass downwardly and being once more extended to lodge within the recess in the bracket that has received the movable pin.

There are a number of hydraulic systems that can be used to control the operation of this mechanism. For example, the individual hydraulic units for each of two tainter gates can be coupled together by means of a cross over valve. Alternatively, a number of tainter gates can share in common two hydraulic units through suitable cross over connections.

Synchronizing gate operation is accomplished through gate position indicators that regulate fluid flow to the hydraulic cylinders.

Thus, there is provided an entirely new technique for operating tainter gates and, especially, tainter gates of very large size in a manner that completely avoids wirerope and attendant wirerope problems. The mechanical advantage that characterizes this invention, moreover, is a substantial improvement over prior art rack-and-pinion and chain driven devices. Further, because support for apparatus that characterizes the invention is considerably less than that which would be required in a wirerope system for a tainter gate of the same size, there is a considerable saving in structural steel and concrete through the practice of this invention. Additional cost savings also are now possible not only because large, expensive gears and couplings are eliminated, but also, extensive field installation and alignment procedures are significantly reduced.

The novel features of this invention, as well as the invention itself, both as to its organization and operation will best be understood from the accompanying drawings, taken in conjunction with the accompanying description, in which similar reference characters refer to similar parts, and in which:

DESCRIPTION OF THE PREFERRED EMBODIMENTS

Figures 1, 6:
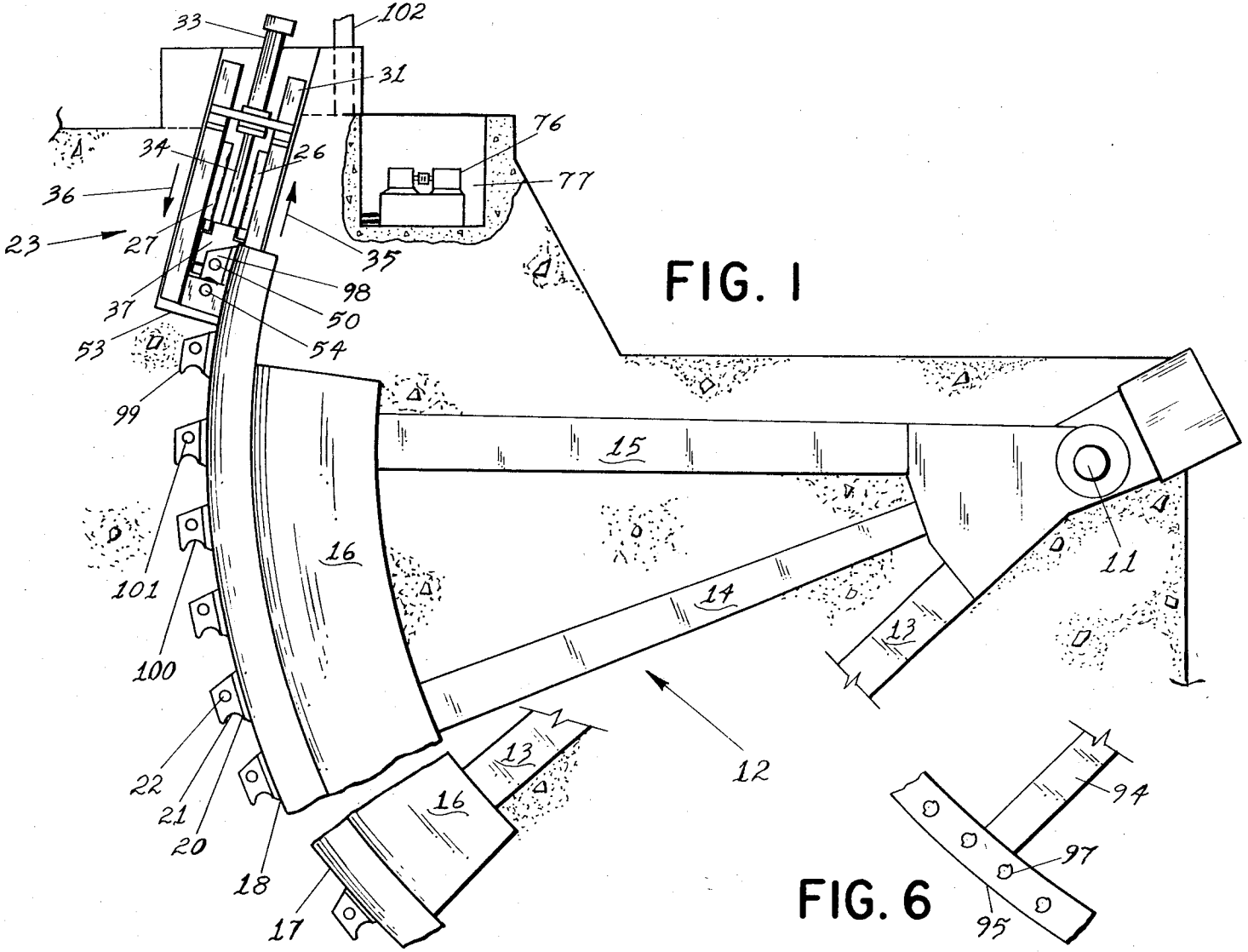
FIG. 1 is a front elevation, in full section of a typical embodiment of the invention.
FIG. 6 is a portion of a tainter gate showing a different arrangement of bores for controlling gate movement.

Referring now to FIG. 1, a concrete pier 10 in a watercourse supports a pintle 11 upon which a tainter gate 12 is hinged. Radially extending members 13, 14 and 15 join the hinge to structural support 16 for an arcuate skin plate 17 on the gate.

In accordance with the invention an array of circumferentially aligned lifting brackets, of which bracket 20 is typical, are secured to the upstream side of the skin plate 17. As shown in the drawing, a flange 18 on the bracket 20 is curved to match the profile of the skin plate 17. In this way, the flange provides a suitable means for attaching the bracket 20 to the tainter gate 12 through welds, bolts, and the like to sustain imposed gate loads. Thus, the bracket 20 is sufficiently sturdy to sustain at least half of the applied load that is involved in raising and lowering the tainter gate 12. The other portion of this gate load is borne by a companion mechanism that is not shown in the plane of FIG. 1 of the drawing.

Returning now to the bracket 20, a semicircular, horizontally disposed recess 21, or aperture, is formed in the undersurface of the bracket. An horizontal aperture or bore 22 also is formed in the central portion of the web of the bracket 20. Particular note should be taken of the transverse shape of the bore 22, the lower semicircular half of the bore having a substantially larger diameter than the upper semicircular half of the same bore. The functional importance of this unique and distinctive cross section for the bore 22 will be described subsequently.

Figure 2:
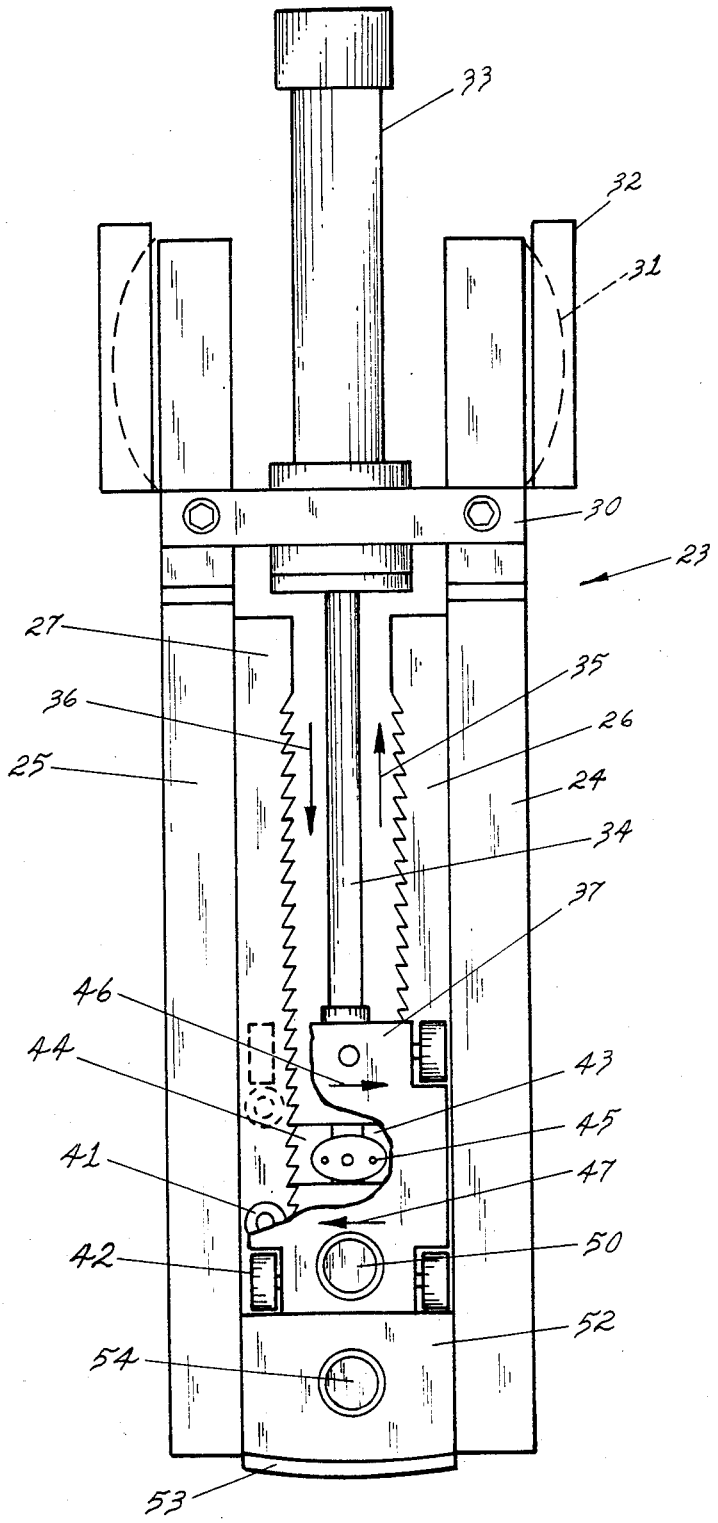
FIG. 2 is a front elevation of a typical lifting mechanism for use with the apparatus shown in FIG. 1.
Figure 3:
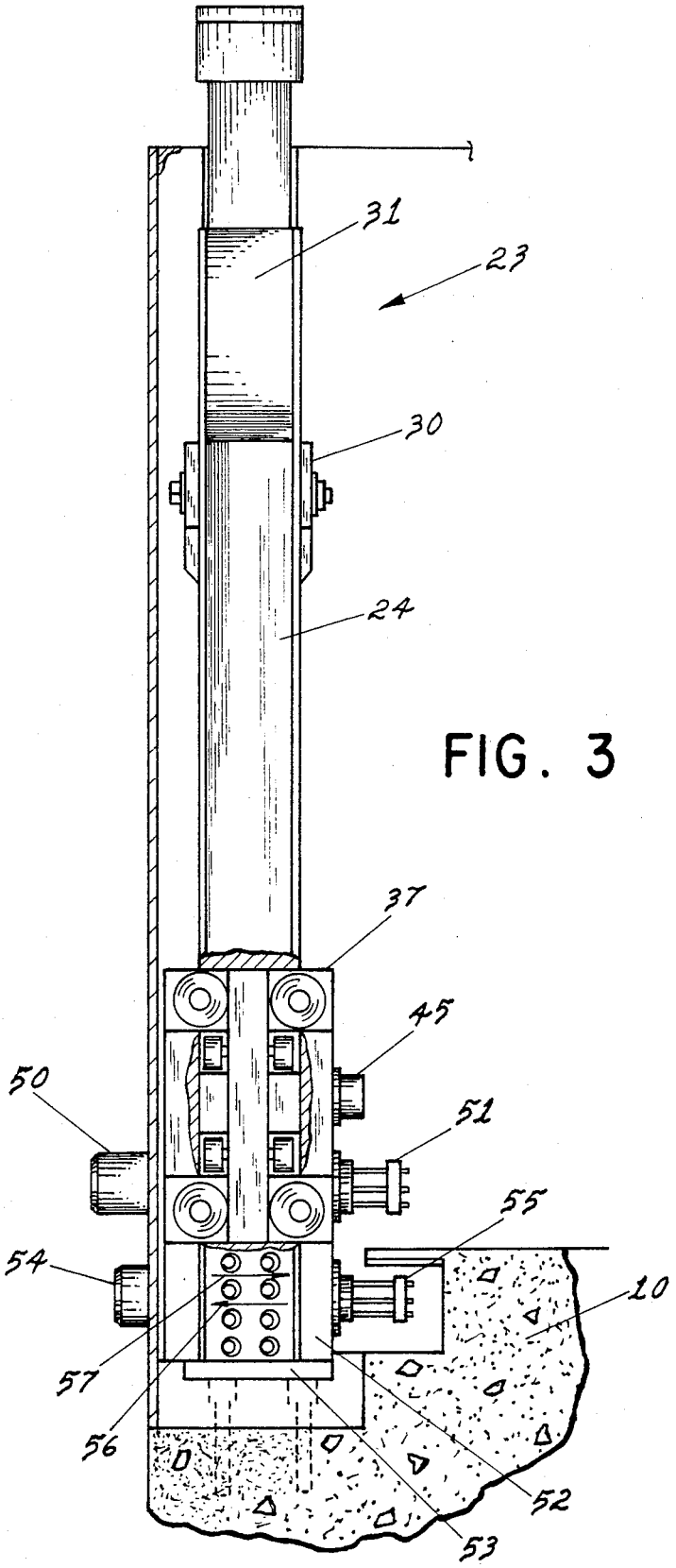
FIG. 3 is a side elevation of the lifting mechanism shown in FIG. 2.

The pier 10 also supports a lifting mechanism 23 which is shown in more detail in FIGS. 2 and 3. As illustrated in FIGS. 2 and 3, the lifting mechanism 23 has a pair of spaced, parallel guide rails 24,25. Ratchets 26,27 are mounted on opposing respective faces of the guide rails 24,25. The ratchet and guide rail combinations are joined toward the top ends by means of bracing 30.

The upper end of the guide rails supports a semi-disk-like pivot pad 31, the arcuate parts of the outer surfaces of the pivot pad being journalled, within a mating pillow block 32. An hydraulic cylinder 33 is supported by the bracing 30. For the purpose of this invention, the cylinder 33 responds to an application of hydraulic fluid under pressure to move a piston rod 34 in the direction of arrow 35. The cylinder, however, acts in the manner of an "oleo strut" by permitting the piston rod 34 to move in the direction of arrow 36 in a controlled manner under the weight of the tainter gate (now shown in FIGS. 2 and 3) to slowly and gently lower the gate as described subsquently in more complete detail.

The piston rod 34 is attached to a cart 37. As shown in FIGS. 1 and 3, sets of idler wheels are mounted on the cart 37. The wheels roll on surfaces that are provided by the guide rails 24,25 and the ratchets 26,27, respectively, in order to align the cart 37 for the movement in the directions of the arrows 35,36 between the guide rails.

Two horizontally translatable pawls 43,44 are mounted within the cart 37 in order to engage and to disengage teeth on the respective ratchets 26,27. The pawls 43,44 mesh with corresponding sets of ratchet teeth in a manner that locks the cart 37 in with the teeth on the ratchets 26,27 and prevent movement principally in the direction of the arrow 36.

To engage the pawls 43,44 with the respective ratchets and to release them from these ratchets, a latching device 45 is attached to the cart 37. The latching device is linked to the pawls 43,44 and, upon activation, moves the pawl 43 in the direction of the arrow 46 and pawl 44 in the direction of the arrow 47 to press them into engagement with adjacent sets of ratchet teeth. The disengage the pawls 43,44 from these teeth the latching device 45 is energized to move pawl 44 in the direction of arrow 46 and pawl 43 in the direction of arrow 47 thereby draws the pawls in an horizontal direction further within the cart 37.

In accordance with another aspect of the invention, an horizontally movable pin 50 is mounted in the cart 37. As shown, the motion of the pin 50 is controlled by means of a movable pin hydraulic operating cylinder 51 which drives the pin in an horizontal direction that is perpendicular to the plane of the ratchets 26,27. The pin 50, moreover, is considered a movable pin because it is mounted integrally with the cart 37 in order to move with that cart in the direction of the arrows 35,36. The movable pin 50 also must have sufficient strength to support about half the weight applied in raising and lowering the tainter gate 12, the other portion of this load being carried by a corresponding mechanism that is not projected in the plane of FIG. 1 of the drawing. Further with respect to the pin 50 (FIGS. 2 and 3), the diameter of this pin is equal to or slightly smaller than the corresponding diameter of the semicircular upper half of the bore 22 (FIG. 1) of the lifting bracket 20. The pin diameter, however, is substantially smaller than the diameter of the lower semicircular half of the bore 22. In this manner, and as described more thoroughly in a subsequent portion of this specification, the unique transverse cross section of the bore 22 provides an automatic self-centering feature for the pin 50. As the pin 50 is inserted into the bore 22, any misalignment within a structurally acceptable range between the pin and the bore is absorbed by the lower, larger diameter semicircular part of the bore which guides and seats the pin in a snug fit within the upper semicircular half of the bore.

The length of the pin 50 (FIGS. 2 and 3), or at least the length of its stroke in response to operation of the movable pin cylinder is at least equal to the corresponding depth of the bore 22 (FIG. 1).

Returning once more to FIGS. 2 and 3, the lower ends of the guide rails 24,25 are joined together by means of a pivot pad assembly 52. The lowermost end of the pivot pad assembly 52 terminates in an arcuate pivot pad 53 that provides a degree of flexibility and resiliency in mounting the lifting mechanism 23 with respect to the pier 10. The small degree of freedom of motion that the pivot pads 31 and 53 impart to the lifting mechanism 23 enable this mechanism to adjust itself to the changing angular relationship that it must undergo relative to the curvature of the skin plate 17 (not shown in FIGS. 2 and 3) on the tainter gate 12 as the lifting mechanism draws the gate upward or lowers it downward, as subsequently described.

A stationary pin 54 also is mounted in the pivot pad assembly 52 for movement in an horizontal direction that is perpendicular to the plane of the ratchets 26,27. This horizontal movement of the stationary pin 54 is regulated by means of an hydraulic stationary pin cylinder 55 (FIG. 3) that drives the pin in the direction of arrow 56 to position the pin 54 under the recess 21 (FIG. 1) of the bracket 20 or to move the pin in the direction of arrow 57 in order to withdraw the pin from the recess.

Figure 4:
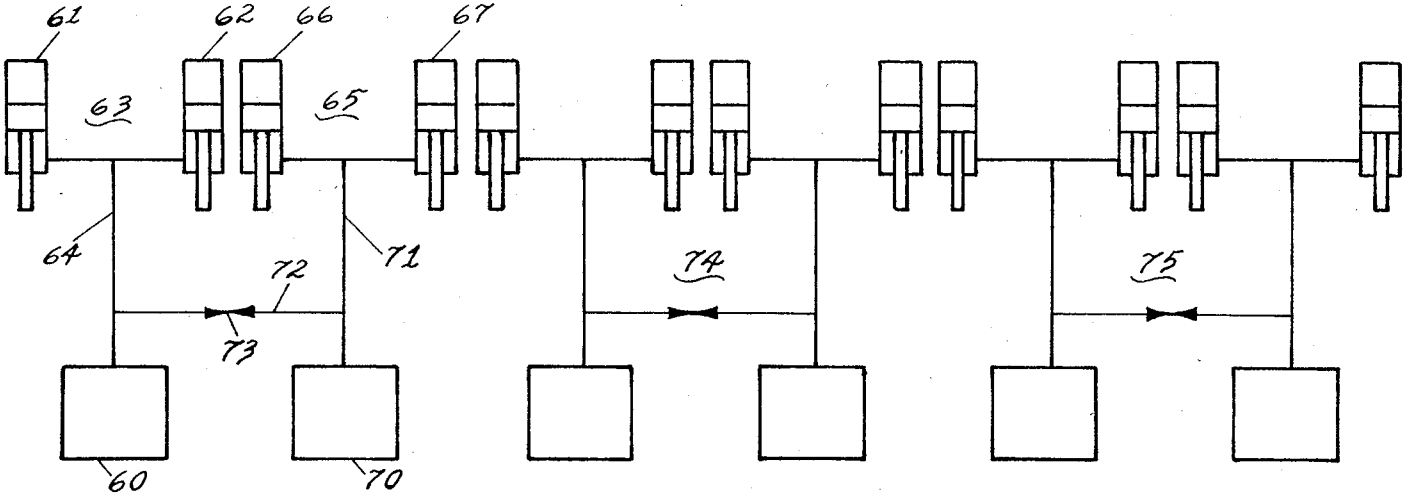
FIG. 4 is a schematic diagram of an hydraulic system for use in connection with the invention.

Attention now is invited to FIG. 4, which shows a specific example of an hydraulic fluid distribution system for an array of six tainter gates that embody principles of the invention. An hydraulic unit 60 produces a sufficient volume of hydraulic fluid under pressure to operate lifting mechanisms 61,62 for a tainter gate 63 in the manner subsequently described. the pressurized hydraulic fluid is coupled to the lifting mechanisms, moreover, through a conduit 64. Companion tainter gate 65, operated by means of paired lifting mechanisms 66,67, is powered through an hydraulic unit 70 that is coupled to the lifting mechanisms via a conduit 71. Cross feed between the lifting mechanisms for the two tainter gates 63,65 and their respective hydraulic units 60,70 is provided by way of a cross feed conduit 72 and a cross over valve 73 that permits or interrupts hydraulic fluid transfer between the two gate control systems. Parallel sets of cross feed hydraulic power systems are provided for the remaining two pairs of tainter gates 74,75.

In FIG. 1, a typical hydraulic unit 76 is shown in a machinery room 77 in the pier 10.

Figure 5:
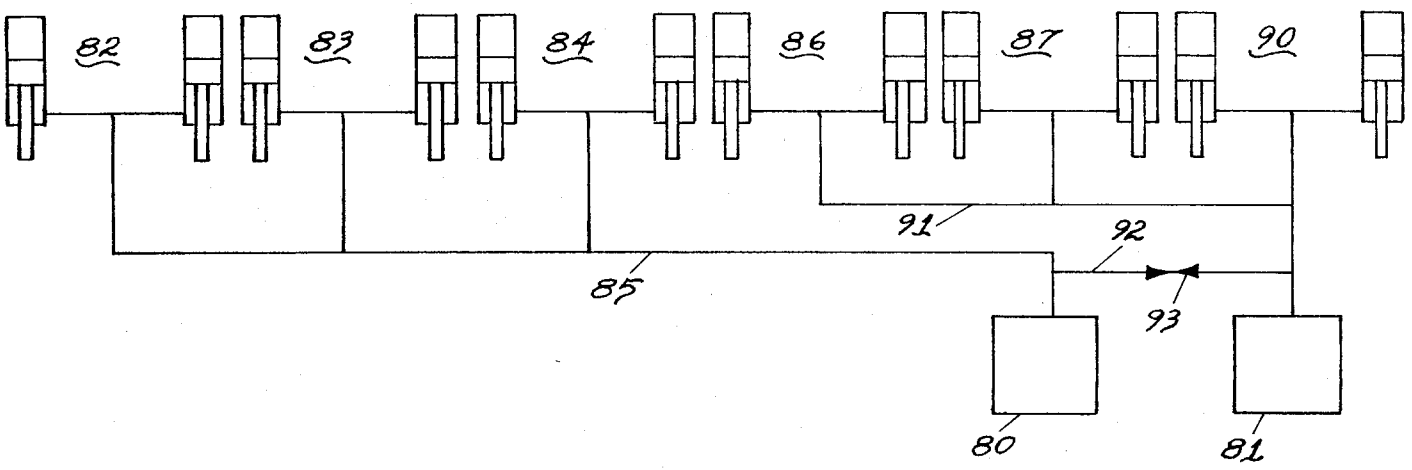
FIG. 5 is a schematic diagram of another hydraulic system for use in connection with the invention.

A further hydraulic power system for an array of six tainter gates is shown in FIG. 5. Two hydraulic units 80,81 are installed on the reservation adjacent to the tainter gate array. The hydraulic units 80,81 are of substantially larger capacity than those which were described in connection with FIG. 4 in order to each individually provide sufficient hydraulic fluid volume and pressure to power all six of the tainter gates. As shown, the hydraulic unit 80 is connected to lifting mechanisms for tainter gates 82,83,84 through a conduit system 85. In turn, the hydraulic unit 81 is directly coupled to lifting mechanisms for tainter gates 86,87 and 90 via a conduit system 91. Cross feed between the two conduit systems 85,91 is achieved through a cross feed conduit 92 that is interrupted by a cross over valve 93.

A further embodiment of another salient aspect of the invention is shown in FIG. 6. A portion of a tainter gate 94 is illustrated in which skin plate 95 is provided with structural support 96. Lifting mechanism bore 97 is formed in the structural support 96. In this manner the requirement for the brackets that are shown in FIG. 1 is avoided while nevertheless achieving the purposes of the invention.

Figure 7:
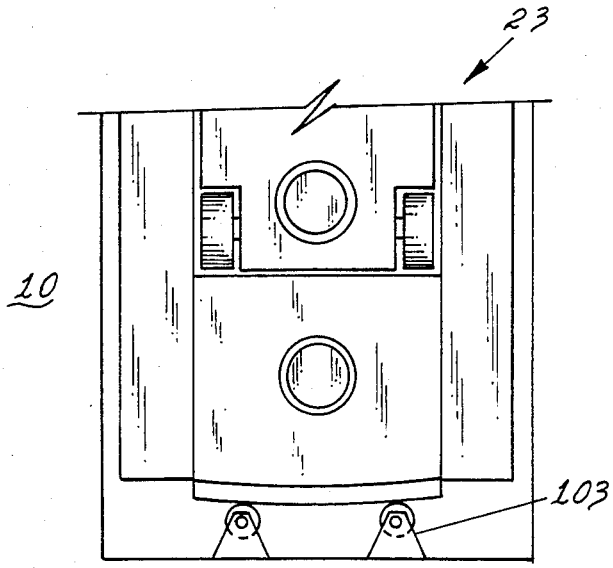
FIG. 7 is a portion of the lifting mechanism showing a different way of supporting the mechanism on the pier.

A further embodiment of another salient aspect of the invention is shown in FIG. 7. The lower portion of the lifting mechanism 102 is illustrated in which the pivot pad 53 (FIG. 2) is replaced with rollers 103 incorporating journals or antifriction bearing. In this manner, friction between the lifting mechanism 23 and the pier is reduced, while nevertheless achieving the purpose of the invention.

Figure 8:
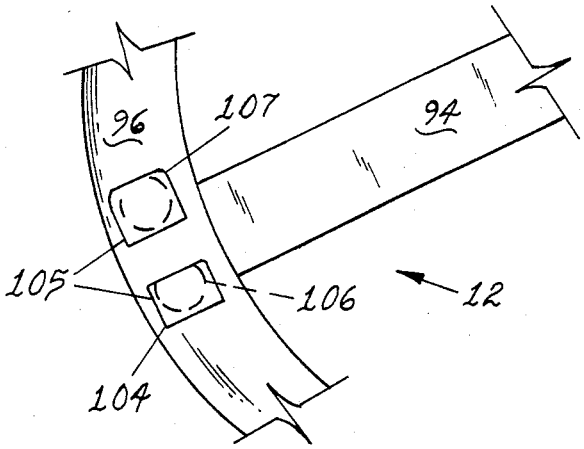
FIG. 8 is a portion of a tainter gate showing a different bottom bore hole for controlling gate movement.

A still further embodiment of another salient aspect of the invention is shown in FIG. 8. The lower bore hole 104 of the pier of bore holes 105 has a flat top section of length greater than the flat top section of the stationary pin 106. In this manner, the lifting mechanism 23 (FIG. 2) is allowed to shift when the movable pin 50 is being seated into bore hole 107, while nevertheless achieving the purpose of the invention.

In operation, attention now is invited to FIG. 1 which shows the movable pin 50 and the lifting mechanism 23 extended to protrude into a bore in lifting bracket 98. The movable pin 50 in its extended position is best shown in FIG. 3. To raise the tainter gate 12 (FIG. 1), hydraulic fluid under pressure is supplied from the hydraulic unit 76 to the hydraulic cylinder 33 to draw the piston rod 34 and the attached cart 37 in the direction of the arrow 35. In this condition, the stationary pin 54 is retracted into the pivot pad assembly 52, again as illustrated in FIG. 3, to enable lifting bracket 99 (FIG. 1) to clear the pin 54 and pass upwardly as the piston rod 34 and the attached cart 37 with the bracket 98 on the skin plate 17 coupled to the pin 50 all are drawn in the direction of the arrow 35.

Because of the curved nature of the skin plate 17, the angular relation with the longitudinal axis of the lifting mechanism is constantly changing while the piston rod 34 draws the tainter gate 12 in an upward direction. As hereinbefore mentioned, the pivot pads 31 and 53 provide a sufficient degree of freedom of motion for the lifting mechanism 23 to adjust to these slight angular changes.

Should it be desired to arrest the upward motion of the gate 12 at some intermediate point, the hydraulic pressure is stabilized and the pawls 43,44 (FIG. 2) are extended from the cart 37 (FIG. 1) to engage the adjacent teeth in the ratchets 26,27. To resume the upward movement of the tainter gate 12, hydraulic pressure is once more applied to the cylinder 33, and the pawls without pressure of the gate acting on them are retracted into the cart 37. The cart and the gate is then propelled upward by the applied hydraulic pressured.

The stationary pin 54 is extended when the piston rod 34 has reached a point in its upward travel such that the stationary pin is oriented slightly below the semicircular recess 100 in the lifting bracket 99. Hydraulic pressure in the cylinder 33 is slowly relieved to allow the lifting bracket 99 to settle downwardly onto the extended stationary pin 54. As the pin 54 is seated in the recess 100 and absorbs the load from the gate 12, the movable pin 50 is no longer sustaining this load and can be extracted from the aperture in the bracket 98 with relatively little force. Upon withdrawing the movable pin 50 from the bore in the bracket 98, the hydraulic cylinder 33 runs the cart 37 in the direction of the arrow 36 until the movable pin 50 is in general alignment with bore 101 in the lifting bracket 99. At this point, the self aligning feature of unique transverse cross section that characterizes the brackets herein before described accommodates minor misalignments between the movable pin 50 and the bore 101.

The gate load then is once more transferred to the movable pin 50 as the hydraulic cylinder 33 is activated to draw the cart 37, the movable pin 50 and the attached bracket upward in the direction of the arrow 35, whereupon the stationary pin 54 is retracted to permit the next lower adjacent bracket to pass upwardly in the direction of the arrow 35. And thus, the process described above is repeated until the tainter gate 12 has been lifted to the desired height.

To close or to lower the gate 12, the movable pin 50 is seated in a raised bracket bore and the hydraulic pressure is relieved in a controller manner in order to enable the recessed undersurface of the bracket that is being lowered to settle onto the extended stationary pin 54. Upon seating the lowered bracket on the stationary pin 54 and transferring the gate load to that pin, the movable pin 50 is extracted from the bore in that bracket. The hydraulic cylinder 33 is once more energized to move the cart 37 and the movable pin 50 upwardly in the direction of the arrow 35. At the end of this increment of upward travel, the movable pin is inserted into the bore of the next bracket and the gate load now is transferred to the movable pin 50 by drawing the cart slightly upward in the direction of the arrow 35. The stationary pin 54 is retracted and, as the hydraulic cylinder 33 lowers the tainter gate through one more step, the bracket that just had been supported on the stationary pin 54 passes that pin by moving downwardly in the direction of the arrow 36. After the downwardly moving bracket has cleared the stationary pin 54, the stationary pin is once more extended in order to engage the recessed undersurface of the bracket that is next above and which is moving downwardly in the direction of the arrow 36 under the control of the movable pin 50 and the hydraulic cylinder 33. Naturally, the pawls 43,44 (FIG. 2) in the cart 37 can be activated to arrest the downward motion of the tainter gate 12 (FIG. 1) at an intermediate point between adjacent brackets by meshing the teeth on the pawls with the adjacent ratchet teeth.

Operation of a tainter gate in which the bore 97 (FIG. 6) is formed in the structural support 96 of the skin plate 95 is accomplished in the same manner as that which was described above in connection with the FIG. 1 embodiment of the invention.

As illustrated in FIG. 4, the hydraulic unit 60 can service the lifting mechanisms for both of the tainter gates 63,65 if the cross over valve is open. Further in this regard, hydraulic fluid pressure equalization between all of the four lifting mechanisms 61,62 and 66,67 also is attained if the valve 73 is open. This pressure equalization produces a generally uniform opening and closing operation for both of the gates 63,65 in which the movements of the gates 63,65 are equal. Fine synchronization between the gates is accomplished through position indicators (not shown) on the machinery. These position indicators control fluid flow to the hydraulic cylinders through flow modulating valves. Further in this respect, the position of the movable and stationary pins is identified through an electrical control system (also not shown) that presents a reflection of current equipment position status at a control stand 102. The actual operation of the movable pin 50 (FIG. 3), the stationary pin 54, and the latching device 45 as illustrated in this embodiment of the invention are hydraulically activated and electrically controlled. Naturally, other techniques for operating these pins and pawls are within the scope of the invention.

Attention now is invited to FIG. 5 which shows an entire array of tainter gates 82 through 87 and 90 that are operated through hydraulic fluid supplied from the units 80,81 in which flow can be transferred and system pressure can be controlled by means of the cross over valve 93.

Thus, there has been provided a novel tainter gate lifting system that eliminates wirerope control and the problems associated with the application of wirerope to very large gates. It is estimated, for example, that the techniques characterizing the instant invention are capable of raising a 75 feet high by 62 feet wide tainter gate at a rate of at least one foot per minute. In this projected gate, the adjacent brackets are spaced a distance of 7 feet from each other and the distance travelled by the gate to settle onto a stationary pin in transferring a gate load from a movable pin to a stationary pin is ¼ inch. The tooth spacing on the ratchets 26,27, moreover, will provide fine position control for the gate in 4 inch increments.

I claim:

1. A lifting mechanism for raising and lowering a tainter gate with respect to a pier comprising a. a tainter gate having a plurality of lifting apertures associated therewith;

b. a plurality of pins positioned adjacent said apertures such that said pins may selectively engage and disengage said apertures; and c. pin control means for controlling the engagement and disengagement of said pins with said apertures and for controlling the raising and lowering of certain of said pins with respect to other of said pins to raise and lower said tainter gate in a step sequence, said control means being affixed to the pier.

2. The apparatus of claim 1 wherein said plurality of pins includes:

a. at least one stationary pin; and b. at least one movable pin spaced apart from said stationary pin; and wherein said pin control means includes;

c. means for raising and lowering said movable pin with respect to said stationary pin.

3. The apparatus of claim 1 wherein said pin control means includes a hydraulic piston and cylinder mechanism connected to raise and lower said pins.

4. The apparatus of claim 1 wherein said pin control means includes means for terminating the raising and lowering movement of said pins.

5. The apparatus of claim 4 wherein said terminating means includes a plurality of pawls disposed to engage a plurality of ratchets.

6. The apparatus of claim 1 wherein said tainter gate further includes a plurality of brackets, each said bracket having a web portion with said lifting apertures formed therein.

7. The apparatus of claim 6 wherein said lifting apertures are shaped substantially as a cross-section of two semicircles joined at a common diameter, one of said semicircles having a larger diameter than the other of said semicircles.

8. The apparatus of claim 6 wherein said web portion includes a semicircular recess formed on one side of said web.

9. The apparatus of claim 2 wherein said pin control means includes means for raising said tainter gate by said movable pin engaging a lifting aperture and said stationary pin disengaging a lifting aperture, thereby shifting the tainter gate load from said stationary pin to said movable pin, then said movable pin moving upwardly away from said stationary pin carrying the tainter gate with it, then said movable pin disengaging a lifting aperture and said stationary pin engaging a lifting aperture, thereby shifting the tainter gate load from said movable pin to said stationary pin, then said movable pin moving downwardly toward said stationary pin.

10. The apparatus of claim 9 wherein, said raising means includes means for transferring the tainter gate load from said stationary pin to said movable pin by entering said movable pin into a lifting aperture, then moving said movable pin upwardly until the tainter gate load is transferred from said stationary pin to said movable pin and then withdrawing said stationary pin from a lifting aperture.

11. The apparatus of claim 9 wherein, said raising means include means for transferring the tainter gate load from said movable pin to said stationary pin by entering said stationary pin into a lifting aperture, then moving said movable pin downward until the tainter gate load is transferred from said movable pin to said stationary pin and then withdrawing said movable pin from a lifting aperture.

12. The apparatus of claim 2 wherein said pin control means includes means for lowering said tainter gate by said movable pin engaging a lifting aperture and said stationary pin disengaging a lifting aperture, then said movable pin moving downwardly toward said stationary pin carrying the tainter gate with it, then said stationary pin engaging a lifting aperture and said movable pin disengaging a lifting aperture, said movable pin moving upwardly away from said stationary pin.

13. The apparatus of claim 12 wherein said lowering means include means for transferring the tainter gate load from said stationary pin to said movable pin by entering said movable pin into a lifting aperture, then moving said movable pin upward until the tainter gate load is transferred from said stationary pin to said movable pin and then withdrawing said stationary pin from a lifting aperture.

14. The apparatus of claim 12 wherein said lowering means include means for transferring the tainter gate load from said movable pin to said stationary pins by entering said stationary pin into a lifting aperture, then moving said movable pin downward until the tainter gate load is transferred from said movable pin to said stationary pin and then withdrawing said movable pin from an aperture.

15. The apparatus of claim 2 wherein said raising and lowering means include a hydraulic piston and cylinder mechanism connected to raise and lower said movable pin, with respect to said stationary pins.

16. The apparatus of claim 2 wherein said pin control means includes means for terminating the raising and lowering of said movable pin.

17. The apparatus of claim 16 wherein said terminating means include a plurality of pawls disposed to engage a plurality of ratchets.

18. The apparatus of claim 1 wherein said pin control means includes a plurality of hydraulic pistons and cylinders, one each associated with one of said pins for controlling the engagement and disengagement of said pins with said lifting apertures.

19. The apparatus of claim 1 wherein said lifting apertures are substantially shaped as a cross-section of two semicircles joined at a common diameter with one of said semicircles having a larger diameter than the other of said semicircles.

20. The apparatus of claim 2 wherein said pin control means includes a plurality of hydraulic cylinders, one each associated with each movable and stationary pin for controlling the engagement and disengagement of said pins with said lifting apertures.

21. The apparatus of claim 2 wherein said pin control means comprises means for raising said tainter gate including:

a. first means for shifting the tainter gate load from said stationary pin to said movable pin;
b. second means for moving said movable pin upwardly away from said stationary pin;
c. third means for shifting the tainter gate load from said movable pin to said stationary pin; and
d. fourth means for moving said movable pin downwardly toward said stationary pin.

22. The apparatus of claim 9 wherein said first means includes:

a. means for entering said movable pin into a lifting aperture;
b. means for raising said movable pin until the tainter gate load is transferred from said stationary pin to said movable pin; and
c. means for withdrawing said stationary pin from a lifting aperture.

23. The apparatus of claim 9 wherein said third means includes:

a. means for entering said stationary pin into a lifting aperture;
b. means for lowering said movable pin downwardly until the tainter gate load is transferred from said movable pin to said stationary pin; and
c. means for withdrawing said movable pin from a lifting aperture.

24. The apparatus of claim 2 wherein said pin control means comprises means for lowering said tainter gate including:

a. first means for shifting the tainter gate load from said stationary pin to said movable pin;
b. second means for lowering said movable pin downwardly toward said stationary pin;
c. third means for shifting the tainter gate load from said movable pin to said stationary pin; and
d. fourth means for moving said movable pin upwardly away from said stationary pin.

25. The apparatus of claim 12 wherein said first means includes:

a. means for entering said movable pin into a lifting aperture;
b. means for raising said movable pin until the tainter gate load is transferred from said stationary pin to said movable pin; and
c. means for withdrawing said stationary pin from a lifting aperture.

26. The apparatus of claim 12 wherein said third means includes:

a. means for entering said stationary pin into a lifting aperture;
b. means for lowering said movable pin downwardly toward said stationary pin until the tainter gate load transferred from said movable pin to said stationary pin; and
c. means for withdrawing said movable pin from a lifting aperture.

27. A raising and lowering mechanism for a tainter gate having lifting apertures comprising:

a. a pair of transversely spaced parallel guide rails;
b. an hydraulic cylinder mounted between said guide rails, said cylinder having a piston rod interposed between said guide rails for movement substantially parallel to said guide rails;
c. a cart connected to said piston rod for movement between said guiderails
d. latching means for selectively latching said cart to said guide rails; and
e. a movable pin on said cart for raising and lowering the tainter gate, said movable pin being transversely movable between a first position engaging a lifting aperture and a second position disengaged from a lifting aperture.

28. A raising and lowering mechanism of the type described in claim 27, wherein:

a. a pivot pad assembly secured to one end of the guiderails, and
b. a stationary pin mounted on said pivot pad assembly, said stationary pin being transversely movable between a first position engaging a lifting aperture and a second position disengaged from a lifting aperture.

29. A raising and lowering mechanism of the type described in claim 28, wherein:

a. another pivot pad assembly is attached to the other end of the lifting mecahnism to resiliently support the tainter gate.

30. The apparatus of claim 27 wherein said latching means comprises, a. a pair of transversely spaced rachets each mounted on a respective one of said guide rails; and
b. pawls mounted on said cart for selectively engaging and disengaging said rachets.

31. A method for raising a tainter gate having plurality of bores by using a lifting mechanism having at least one movable pin and at least one stationary pin comprising the steps of:

a. inserting at least one movable pin into a tainter gate bore;
b. raising the movable pin and the tainter gate with respect to said stationary pin,
c. extending at least one stationary pin to engage a tainter gate bore;
d. lowering the tainter gate onto the extended stationary pin thereby transferring the tainter gate load from the movable pin to the stationary pin; and
e. withdrawing the movable pin from the bore.

32. A method for lowering a tainter gate having a plurality of bores by using a lifting mechanism having at least one movable pin and at least one stationary pin comprising the steps of:

a. inserting a movable pin into a tainter gate bore;
b. raising the movable pin and the tainter gate a short distance to remove the weight of the tainter gate from the stationary pin;
c. retracting said stationary pin from a tainter gate bore;
d. lowering the movable pin and the tainter gate with respect to the stationary pin;

e. extending the stationary pin to engage a tainter gate bore;
f. transferring the tainter gate load from the movable pin to the stationary pin; and
g. withdrawing the movable pin from the bore.

33. A method of raising a tainter gate in a step sequence comprising the steps of:
a. providing a plurality of lifting apertures in said tainter gate;
b. providing a lifting mechanism having at least one movable and at least one stationary pin;
c. inserting said movable pin into a lifting aperture;
d. removing said stationary pin from a lifting aperture;
e. lifting said movable pin and therefore said tainter gate with respect to said stationary pin a predetermined distance;
f. inserting said stationary pin into a lifting aperture;
g. removing said movable pin from the lifting aperture;
h. lowering said movable pin said predetermined distance; and
i. repeating steps c–h until said tainter gate has been raised the desired amount.

34. The method of claim 33 including between steps c and d the further step of:
lifting said movable pin a short distance to take the weight of the tainter gate off said stationary pin.

35. The method of claim 33 including between steps f and g the further step of lowering said movable pin a short distance to take the weight of the tainter gate off said movable pin.

36. A method of lowering a tainter gate in a step sequence comprising the steps of:
a. providing a plurality of lifting apertures in said tainter gate;
b. providing a lifting mechanism having at least one movable and at least one stationary pin;
c. inserting said movable pin into a lifting aperture;
d. removing said stationary pin from a lifting aperture;
e. lowering said movable pin and therefore said tainter gate with respect to said stationary pin a predetermined distance;
f. inserting said stationary pin into a lifting aperture;
g. removing said movable pin from the lifting aperture;
h. raising said movable pin from said predetermined distance; and
i. repeating steps c–h until said tainter gate has been lowered the desired amount.

37. The method of claim 36 including between steps c and d the step of lifting said movable pin a short distance to take the weight of the tainter gate off said stationary pin.

38. The method of claim 36 including between steps f and g the step of lowering said movable pin a short distance to take the weight of the tainter gate off said movable pin.

39. A method of raising a tainter gate in a step sequence comprising the steps of:
a. providing a plurality of lifting apertures in said tainter gate;
b. providing a lifting mechanism having at least one movable pin and at least one stationary pin;
c. transferring the tainter gate weight from at least one stationary pin to at least one movable pin;
d. lifting said at least one movable pin and therefore said tainter gate with respect to said at least one stationary pin a predetermined distance;
e. transferring the weight from at least one movable pin to at least one stationary pin;
f. lowering said at least one movable pin said predetermined distance;
g. repeating steps c–f until said tainter gate has been raised the desired amount.

40. A method of lowering a tainter gate in a step sequence comprising the steps of:
a. providing a plurality of lifting aperture in said tainter gate;
b. providing a lifting mechanism having at least one movable pin and at least one stationary pin;
c. transferring the tainter gate weight from said stationary pin to said movable pin;
d. lowering said movable pin and therefore said tainter gate with respect to said stationary pin a predetermined distance;
e. transferring the tainter gate weight from said at least one movable pin to said at least one stationary pin;
f. raising said at least one movable pin said predetermined distance; and
g. repeating steps c–f until said tainter gate has been lowered the desired amount.

* * * * *